US005806708A

United States Patent [19]

Schwab

[11] Patent Number: 5,806,708

[45] Date of Patent: Sep. 15, 1998

[54] PRESSURE TIGHT TRAVEL CONTAINER

[76] Inventor: John Schwab, 6834 False River Rd., Oscar, La. 70762

[21] Appl. No.: 789,188

[22] Filed: Jan. 24, 1997

[51] Int. Cl.[6] ..... B65D 25/04

[52] U.S. Cl. ..... 220/552; 220/533; 220/378; 220/532

[58] Field of Search ..... 220/552, 532, 220/533, 529, 526, 378

[56] References Cited

U.S. PATENT DOCUMENTS

| | | | |
|---|---|---|---|
| 948,434 | 2/1910 | Scott | 220/532 |
| 3,200,983 | 8/1965 | Walter | 220/533 |
| 3,275,329 | 9/1966 | Lieberman et al. | 220/526 |
| 4,116,352 | 9/1978 | Davis | 215/270 |
| 4,499,997 | 2/1985 | Swingley, Jr. | 220/552 |
| 4,593,816 | 6/1986 | Langenbeck | 220/533 |
| 4,828,133 | 5/1989 | Hougendobler | 220/553 |
| 4,942,970 | 7/1990 | Jay | 215/358 |
| 4,966,295 | 10/1990 | Parrish | 220/553 |
| 5,065,885 | 11/1991 | Scaroni | 220/378 |
| 5,299,688 | 4/1994 | McKay et al. | 220/553 |

FOREIGN PATENT DOCUMENTS

| | | | |
|---|---|---|---|
| 887404 | 11/1943 | France | 220/552 |

*Primary Examiner*—Stephen J. Castellano
*Attorney, Agent, or Firm*—Warner J. Delaune

[57] ABSTRACT

A pressure tight travel case for airline passengers for use in the unpressurized baggage compartment of an aircraft, comprising a container having side walls and a bottom defining an opening and a cavity; a first partition removably insertable within the cavity, wherein the first partition includes opposing side edges, a top edge and a bottom edge; and a cover matable with the container to close the cavity, the cover including a sealing device for creating a seal between the cover and the container sufficient to prevent pressurized air within the container from leaking through the sealing device during flight. The travel case further includes guiding grooves for guiding the insertion of the first partition into the cavity, and wherein the opposing side edges of the first partition are formed to matably engage the guiding grooves. Optionally, a second partition may be added which is matable with the first partition and the guiding grooves, wherein the second partition includes opposing side edges formed to matably engage the guiding grooves. Preferably, the guiding grooves and the opposing side edges of the first and second partitions are formed to create an interlocking connection sufficient to minimize pressurized expansion of the side walls of the container.

6 Claims, 3 Drawing Sheets

PRESSURE TIGHT TRAVEL CONTAINER

BACKGROUND OF THE INVENTION

I. Field of the Invention

The present invention relates generally to containers for holding personal effects, cosmetics and toiletries, and more particularly to such containers as may be stored in luggage during air travel. This invention further relates to containers which are capable of preventing impermissibly large changes in internal pressure within such containers.

II. Description of Prior Art

When airline passengers travel, it is common for them to carry a selection of toiletries and other personal hygiene products, especially when the destination requires overnight lodging. Examples of such products include toothpaste, shampoo, baby oil, after shave lotion, contact lens cleaning solution, and many others. In many cases, travelers place their toiletries inside a zippered bag or a separate travel case, which is then placed directly into the luggage. If the luggage is to be checked in for placement into the baggage compartment of the airplane, it is subject to a potentially wide range of temperatures and pressures. For example, after the luggage leaves the check-in counter, it may be temporarily placed onto an outside cart until the handlers are ready to load it onto the airplane. During this period of time, it may be exposed to the sun, thereby heating the contents of the luggage, including the toiletries.

Furthermore, the luggage is typically stored in areas of the plane which are subject to the variations of temperature and pressure which occur as a function of altitude. Specifically, the temperature and pressure within the baggage compartment will decrease substantially as the airplane reaches cruising altitude, often times subjecting the luggage contents to temperatures below their particular freezing points. Moreover, the lower pressure will cause the walls of many toiletry containers, such as those constructed of plastic or other flexible materials, to expand. This combination of temperature and pressure extremes during high-altitude flight occasionally causes loose caps or covers of such containers to open, and can sometimes trigger bursting of the container itself. In either case, the contents of the container are spilled onto surrounding clothes and other personal effects, causing a tremendous amount of inconvenience and frustration for the traveler.

One solution to such problems would be to manufacture durable and leak-proof containers for each of the toiletry items carried by most airline passengers. However, it is unlikely that the various manufacturers of such products would ever coordinate their efforts and create specially packaged toiletries to withstand temperature and pressure extremes. Another solution might be to control the temperature and pressure within the entire baggage compartment, but the economics of air travel may make this cost prohibitive. Alternatively, the desired toiletries may simply be stored in any carry-on luggage within the pressurized cabin, although there are many instances when this may not be possible. Consequently, the most common solution for travelers has been to place toiletries and cosmetics in flexible, leak-resistant bags which reside within the luggage. Such bags are quite effective in preventing spilled liquids from contacting clothes and other luggage contents, but they do nothing to solve the original problems explained above. In fact, the widespread use of such toiletry and cosmetics bags emphasizes an acceptance of the problem and constitutes an acknowledgment that no viable solution currently exists.

A more appropriate solution would involve maintaining the pressure and/or temperature of the toiletry containers at a level approximating ground level conditions throughout the entire flight, even when they are in the non-pressurized areas of the baggage compartment of the aircraft. However, no known travel cases afford this level of protection from these separate, but related, environmental extremes. Admittedly, containers do exist which will provide pressure-tight or hermetically sealed containment, such as those described in U.S. Pat. No. 4,116,352 and U.S. Pat. No. 4,942,970. In addition, the containers used in the canning of fruits and vegetables provide similar protection for their contents. However, such devices were never intended for use by the frequent traveler and consequently lack the convenient features one would want in a complete solution to the aforementioned problems. The same deficiencies apply to those commonly available containers which include thermally insulated walls or internal glass vessels, such as those designed to hold hot or cold beverages. The disadvantages of using a breakable container in a travel environment are quite understandable and need no further elaboration. Finally, most existing travel cases, as ingenious and convenient as they may be, are not designed to withstand any temperature and pressure changes, let alone maintain the contents at ground level conditions.

Therefore, a travel container is needed which provides miscellaneous toiletry items with protection against both temperature and pressure variations which might cause spillage of the toiletries' contents, and which includes conveniences commonly found in other types of conventional travel containers. Since the primary goal in the design of such a travel container is the prevention of pressure changes within the container, it is necessary to identify those events or structural features which are responsible for such pressure changes.

First, since the travel container must be opened and closed to allow placement and removal of the desired toiletries, leakages at the container/cover interface would be the primary concern. For example, if the pressure differential is large enough to overcome any weaknesses in the closure, the pressure inside the container will attempt to stabilize with respect to the pressure outside the container. Second, even if the closure were sufficient to prevent equalization of the pressure through the container/cover interface, the materials of construction and the flexibility of the container walls may allow expansion of the entire container in response to external pressure conditions. This expansion of the container walls may cause enough change in pressure within the container to allow rupture or opening of the toiletry bottles and tubes themselves. It is with these considerations in mind that the present invention is now disclosed.

SUMMARY OF THE INVENTION

It is therefore an object of this invention to provide a pressure tight travel container which minimizes the pressure changes within the container when exposed to high-altitude pressure and temperature extremes.

It is also an object of this invention to provide a pressure tight travel container which is simple to use and sufficiently compact to fit in most luggage.

It is a further object of this invention to provide a pressure tight travel container which can be internally partitioned.

Yet another object of this invention is to provide a pressure tight travel container which optionally can be thermally insulated.

These and other objects and advantages of the present invention will no doubt become apparent to those skilled in the art after having read the following description of the preferred embodiment which are contained in and illustrated by the various drawing figures.

Therefore, in a preferred embodiment, a pressure tight travel case for airline passengers is provided, comprising a container having side walls and a bottom defining an opening and a cavity; a first partition removably insertable within said cavity, wherein said first partition includes opposing side edges, a top edge and a bottom edge; and a cover matable with said container to close said cavity, said cover including sealing means for creating a seal between said cover and said container sufficient to prevent pressurized air within said container from leaking through said sealing means during flight. The travel case further includes guiding means for guiding the insertion of said first partition into said cavity, and wherein said opposing side edges of said first partition are formed to matably engage said guiding means. Optionally, a second partition may be added which is matable with said first partition and said guiding means, wherein said second partition includes opposing side edges formed to matably engage said guiding means. Preferably, said guiding means and said opposing side edges of said first and second partitions are formed to create an interlocking connection sufficient to minimize pressurized expansion of said side walls.

DETAILED DESCRIPTION OF THE PREFERRED EMBODIMENTS

Figure 1:
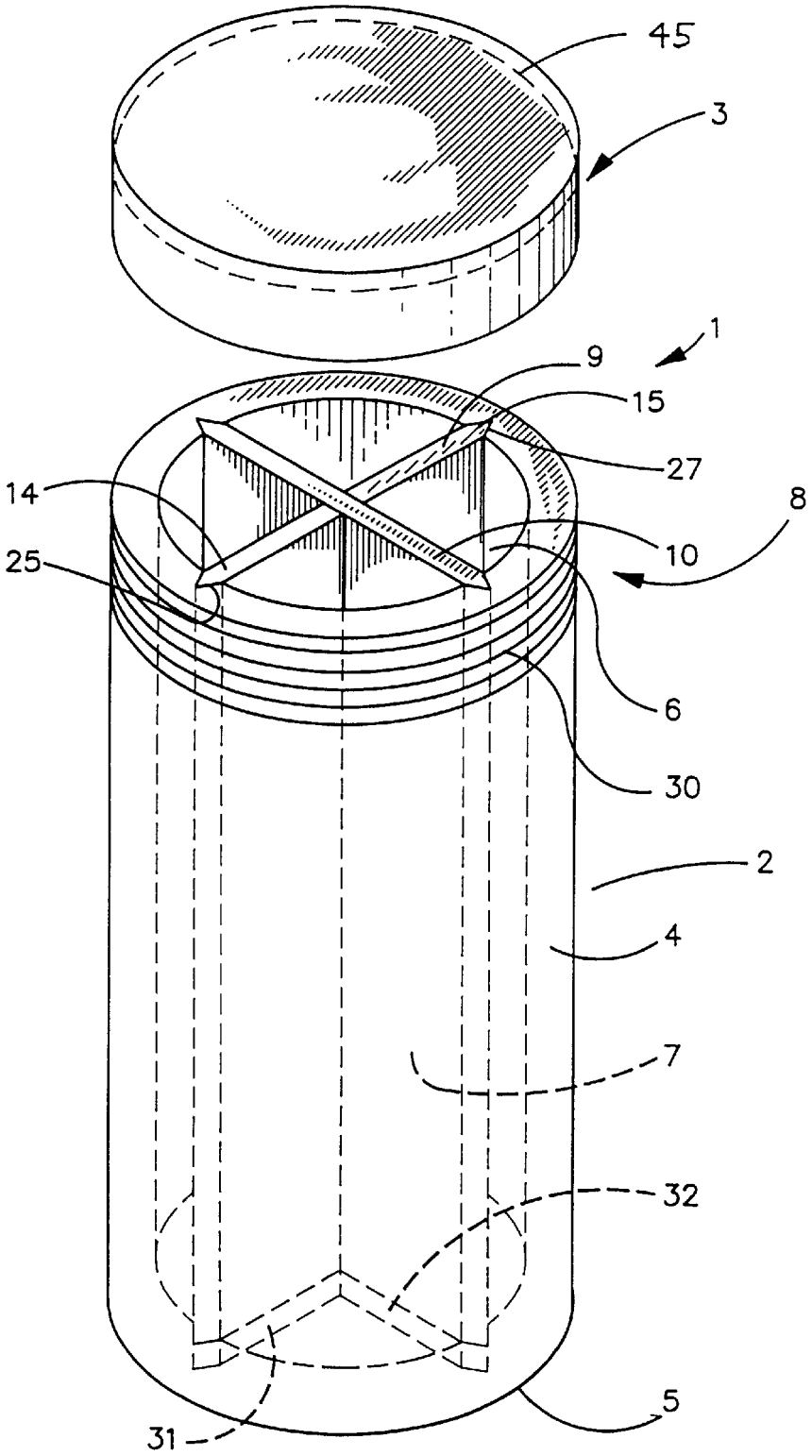
FIG. 1 is a perspective view of one embodiment of the present invention depicting the inserted partitions within the container.

Turning now to FIG. 1, the pressure tight travel container 1 is shown to generally comprise a cylindrically shaped enclosure 2 and a cover 3. Enclosure 2 includes a continuous side wall 4 and a bottom 5 which form an opening 6 to enclosure cavity 7. Cover 3 is matingly engageable with enclosure 2 by way of interlocking closure means 8, which will be further described below.

Figure 2A:
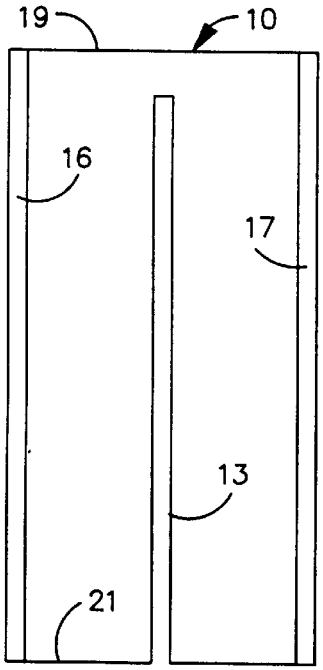
FIGS. 2A and 2B are elevation views of the mating partition halves.
Figure 2B:
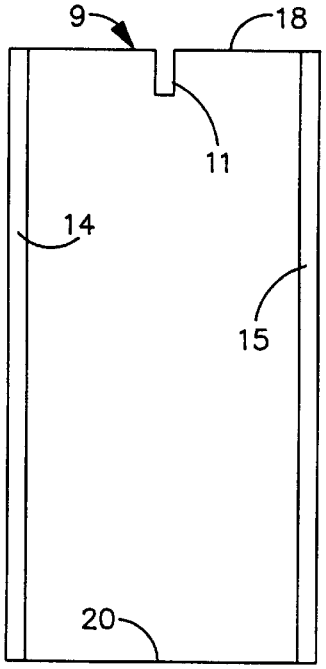

As a means of separating the contents of container 1, a pair of optional partitions 9,10. shown in FIGS. 2A and 2B, are removably insertable within enclosure 2. Four identically shaped side wall slots 25–28 are formed vertically along the inside of side wall 4, circumferentially spaced from one another at approximately 90°, to correctly orient partitions 9,10. Also, a pair of lower slots 31,32 may be formed into bottom 5 to help maintain alignment of lower horizontal edges 20,21 of partitions 9,10, respectively. In addition, partition 10 is matable with partition 9 so that partition 9 can be inserted and used alone within enclosure 2, creating two compartments of equal volume. If desired, partition 10 can be inserted perpendicularly to partition 9 so that four compartments of equal volume can be established. To permit the tops of partitions 9,10 to remain flush when container 1 is closed, partition 9 includes a recess 11 which accepts a cross member 12 of partition 10. Likewise, partition 10 includes a vertical slot 13 of sufficient height to accommodate partition 9 when both partitions 9,10 are used.

When one intends to use the partitions 9,10, it may be desirable to keep the toiletries in each compartment fluidically separated from one another in the unlikely event of spillage from individual bottles or tubes. Therefore, it is preferred that the interfaces between the partitions 9,10 and the enclosure 2, as well as the interfaces between the partitions 9,10 themselves should form a water tight seal. Examples of the interfaces where such a seal would be required are between the recess 11 of partition 9 and the cross member 12 of partition 10, between the slot 13 of partition 9 and the partition 10, between the vertical edges 14–17 of both partitions 9,10 and the side wall 4, between the upper horizontal edges 18,19 of both partitions 9,10 and the inside bottom 5, and between the lower horizontal edges 20,21 of both partitions 9,10 and the inside of cover 3.

As stated earlier, cover 3 is matingly engageable with enclosure 2 by way of interlocking closure means 8. Generally speaking, interlocking closure means 8 may be any closing relationship between cover 3 and enclosure 2 which establishes a pressure tight seal therebetween. The term "pressure tight seal" is used herein to mean that when container 1 is closed, the air within container 1 will not leak throughout the full range of outside or ambient pressures experienced by commercial aircraft flights and that no leakage will occur for the duration of the flight. In its most basic form, closure means 8 can comprise simple external threads 30 on the outside of enclosure 2, such as shown in FIG. 1, coupled with internal threads and a resilient gasket 45 on the inside of cover 3. Alternatively, interlocking closure means 8 may comprise a more complex device which increases the strength of the seal as pressure increases within the container 1. One such device is described in U.S. Pat. No. 4,116,352, the disclosure of which is incorporated herein by reference.

Figure 3A:
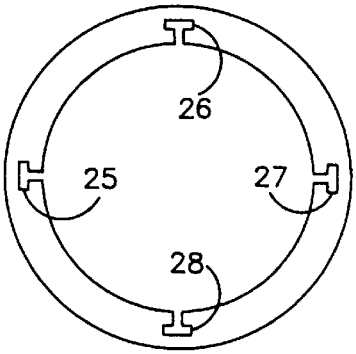
FIGS. 3A–3C are cross-sectional views of three alternative side wall slots for the partitions which provide enhanced rigidity to the side wall.
Figure 3B:
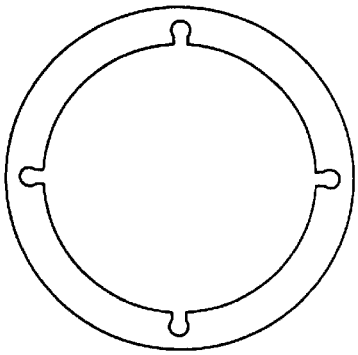
Figure 3C:
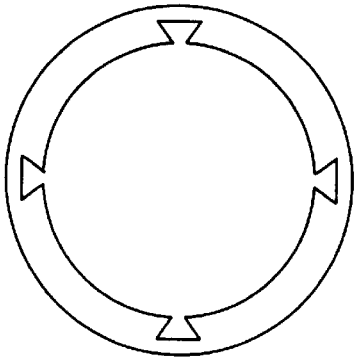

During flight, the pressure external to the container 1 will be lower than that within the container 1, thus creating a force which tends to expand the side wall 4. As previously mentioned, such expansion is undesirable because it will cause the internal pressure to decrease, possibly to the point where the contained toiletries will be adversely affected. Therefore, three alternative embodiments of the side wall slots 25–28 are shown in FIGS. 3A–3C which reinforce the side wall 4 when partitions 9,10 are employed. For example, in FIG. 3A the side wall slots 25–28 are shaped in the form of a "T", which accommodate similarly shaped vertical edges 14–17 of partitions 9,10. When partitions 9,10 are inserted into the enclosure 2, the side wall 4 is uniformly supported because an interlocking connection is established, and its tendency to expand is arrested by the tensile strength of the partitions 9,10. Advantageously, any expansion of the side wall 4 will cause the mating vertical edges 14–17 to make more forceful contact with the slots 25–28, thereby ensuring the integrity of the inter-compartmental seals and preventing a rupture in one compartment from contaminating another compartment. Because of the high tensile forces which may be applied to partitions 9–10 during flight, it is preferred that partitions 9–10 be substantially rigid in construction and formed from a material that exhibits a tensile strength sufficient to withstand such forces with minimal deformation. It is believed that the shapes of side wall slots 25–28 shown in FIGS. 3B and 3C should provide equally satisfactory results.

If ambient temperatures are not a significant concern, which is usually the case, it is preferred that the enclosure 2 be constructed of a material that allows the heat within the container 1 to be thermally conducted to the outside of the container interior during flight. One example of such a material would be a plastic having a high coefficient of thermal conductivity. In other words, it is not a requirement of the present invention that the container 1 be thermally insulated. Lower temperatures inside container 1 will help to maintain the pressure to within acceptable ranges so as to prevent bursting or opening of toiletry containers. On the other hand, if the contents of the container 1 are sensitive to lower temperatures, then the container 1 may optionally be constructed from materials which thermally insulate the container 1, similar to those used in the construction of hot and cold beverage containers. If thermal insulation is employed, the temperature within the container 1 will be kept fairly close to ground level conditions, thus placing a greater burden on the partitions 9,10 in preventing unwanted expansion of the side wall 4.

Figure 4:
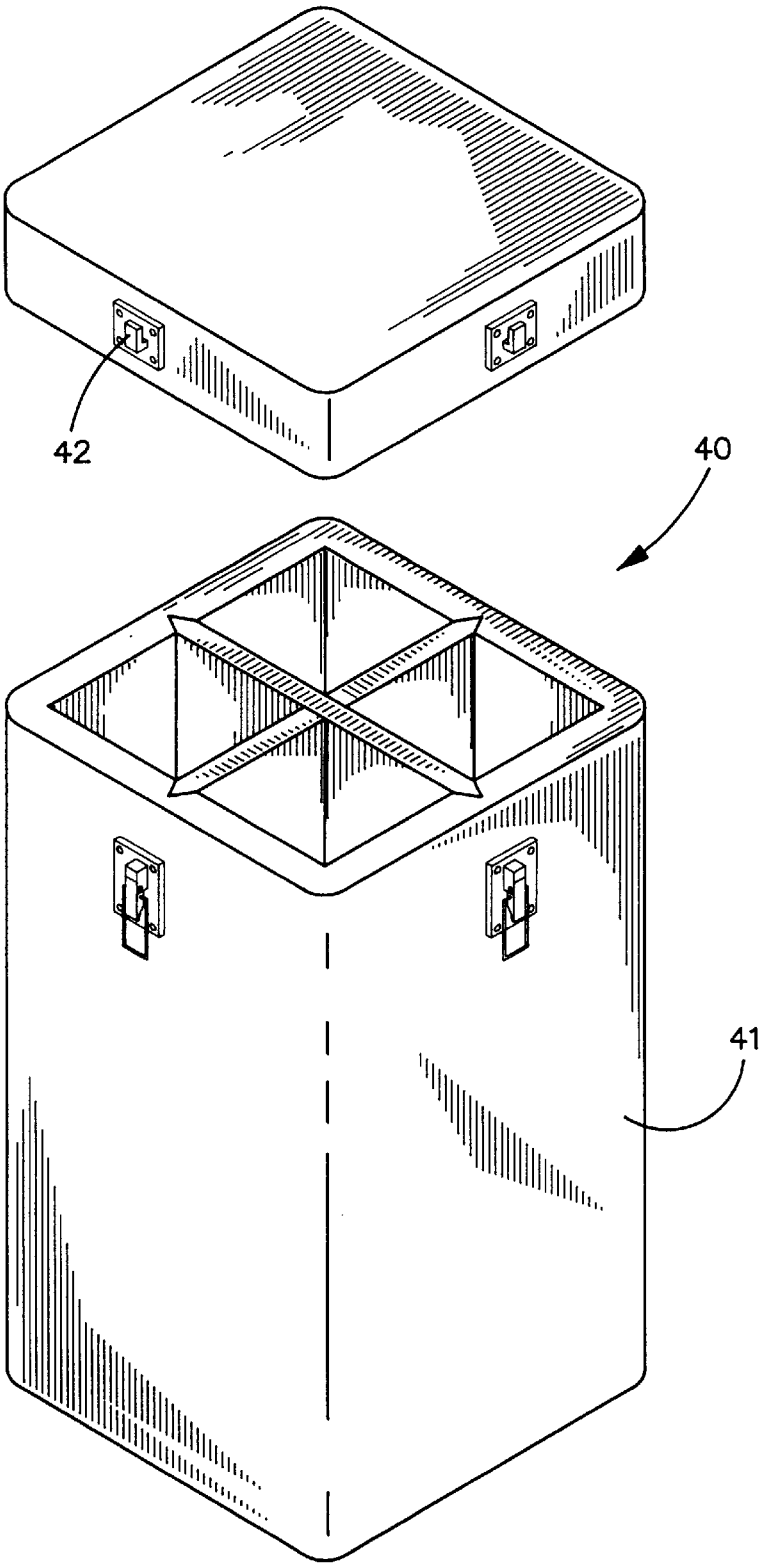
FIG. 4 is a perspective view of an alternate embodiment of the invention depicting a rectangular shape for the container.

FIG. 4 depicts an alternative embodiment of the container 40 having a non-round cross-sectional shape. Because of its shape, the side walls 41 will have a higher propensity to expand than with the continuous side wall 4 in the previous embodiment. Thus, the reinforcing partitions 9,10 described earlier will find greater utility in this embodiment. Also, the non-round cross section does not readily permit the use of a rotatable cover 3. Therefore, the pressure tight seal is created by a plurality of clips 42 on cover 43 which lockingly engage corresponding buckles 44 affixed to container 40. Clips 42 and buckles 43 are arranged in a manner to overcome the resilient forces of a gasket (not shown) within cover 43 so that the required seal is forcibly established.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A pressure tight travel case for airline passengers, comprising:

(a) a container having side walls and a bottom defining an opening and a cavity;

(b) a first partition removably insertable within said cavity, wherein said first partition includes opposing side edges, a top edge and a bottom edge; and (c) a cover matable with said container to close said cavity, said cover including sealing means for creating a seal between said cover and said container sufficient to prevent pressurized air within said container from leaking through said sealing means;

wherein said side walls include guiding means for guiding the insertion of said first partition into said cavity, and wherein said opposing side edges of said first partition are formed to matably engage said guiding means; and wherein the contact between said first partition and said side walls, said cover and said bottom creates a seal which fluidically isolates each comparmnent of said cavity created by said first partition.

2. The travel case of claim 1, wherein said sealing means is a resilient gasket.

3. The travel case of claim 1, wherein said side walls, said bottom, and said cover are thermally insulated.

4. A pressure tight travel case for airline passengers, comprising:

(a) a container having side walls and a bottom defining an opening and a cavity;

(b) a first partition removably insertable within said cavity, wherein said first partition includes opposing side edges, a top edge and a bottom edge; and (c) a cover matable with said container to close said cavity, said cover including sealing means for creating a seal between said cover and said container sufficient to prevent pressurized air within said container from leaking through said sealing means;

wherein said side walls include guiding means for guiding the insertion of said first partition into said cavity, and wherein said opposing side edges of said first partition are formed to matably egmage said guiding means and create an interlocking connection with said guiding means sufficient to minimize expansion of said side walls due to air pressure differentials; and further comprising a second partition matable with said first partition and said guiding means, wherein said second partition includes opposing side edges formed to create a second interlocking connection with said guiding means.

5. The travel case of claim 4, wherein said sealing means is a resilient gasket.

6. The travel case of claim 4, wherein said side walls, said bottom, and said cover are thermally insulated.

* * * * *